United States Patent [19]

Davidson et al.

[11] 4,210,507

[45] Jul. 1, 1980

[54] ELECTROCOATING FLOW CONTROL ELECTRODE AND METHOD

[75] Inventors: John J. Davidson, New Kensington; David A. Smith, Murrysville, both of Pa.

[73] Assignee: Aluminum Company of America, Pittsburgh, Pa.

[21] Appl. No.: 943,154

[22] Filed: Sep. 18, 1978

[51] Int. Cl.[2] ..... B05B 5/02; B05C 7/04; C25D 13/14; C25D 17/12

[52] U.S. Cl. ..... 204/181 R; 204/181 C; 204/299 EC; 204/300 EC; 118/308; 239/598; 204/284

[58] Field of Search ..... 204/181 R, 181 C, 299 EC, 204/300 EC, 284; 118/308; 239/598, 601

[56] References Cited

U.S. PATENT DOCUMENTS 3,410,250 11/1968 Kulie et al. ..... 118/308

4,107,016 8/1978 Brower et al. ..... 204/181 R

*Primary Examiner*—Howard S. Williams

*Attorney, Agent, or Firm*—Patrick J. Viccaro

[57] ABSTRACT

A hollow electrically conductive probe and method are provided for electrocoating a metal container. The probe is insertable into the container, which is preferably inverted, and electrocoating material is flowed through the probe to fill the container with a transient bath of electrocoating material. The probe includes a means for retarding the flow of the electrocoating material from the container interior by establishing an opposing flow of electrocoating material to increase the flow turbulence without creating discontinuities of flow in order to facilitate the electrocoating of corners and recesses near the container bottom. Preferably, peripheral openings about the probe body direct flowing electrocoating material toward the container bottom.

6 Claims, 5 Drawing Figures

ELECTROCOATING FLOW CONTROL ELECTRODE AND METHOD

BACKGROUND OF THE INVENTION

This invention relates to electrocoating a container. More particularly, the invention relates to an electrode probe and method for use of the same for controlling the flow of electrocoating material into the container to be coated.

Usually, metal containers, such as cans and the like, have their interior surfaces and exterior surfaces coated with protective materials, such as resinous coating materials. The interior coating is required for protection of the container from its contents and protection of the contents of the container from reaction with the metal. An exterior coating may improve handling of the container and/or its aesthetic appearance. Additionally, an exterior coating can offer protection against the container environment, such as by inhibiting the rusting of steel and tinfree steel containers in moist atmospheres and forming of excessive oxide on aluminum containers during retorting.

Though the coating materials may be applied by sprays, rolls, immersion or the like, electrocoating techniques may be the most desirable since they can provide uniform and consistent films. A process and apparatus for uniformly electrocoating a container is disclosed in each of U.S. Pat. Nos. 3,922,213 issued Nov. 25, 1975 and 4,094,760 issued June 13, 1978, to the common assignee of the present invention. The method and apparatus of both patents, the disclosures of which are incorporated herein by reference, considerably improve the techniques for electrocoating metal containers in high speed production lines by avoiding the slower prior art processes. U.S. Pat. No. 3,922,213 relates to the uniform electrocoating of the interior of a shaped metal container, while U.S. Pat. No. 4,094,760 is an improvement thereover which permits the electrocoating of both the interior and exterior of a metal container simultaneously. Both patents disclose uniformly electrocoating the metal container in an inverted position by the insertion of an electrically conducting probe-nozzle therein through which coating material is flowed into the interior of the container to fill the container and maintain a transient bath of coating material therein. An electrical potential is impressed between the container and the nozzle to coat the metal surfaces.

The profile of a container bottom end wall can be a complex geometry with bends and curves having various radii of curvature. For example, efforts by the can making industry to produce light weight containers, such as drawn and ironed cans, have resulted in thin gauge container bottoms having a plurality of concave and convex surfaces forming recesses and "corners" with small radii contributing to container wall strength. In addition to designing end wall profiles for container strength, such profiles are also designed for aesthetic appearance and have made electrocoating the small radii "corners" of the metal containers increasingly difficult. Even the process and apparatus of the two above-cited patents which fill a container with a transient bath of electrocoating material have occasionally resulted in coating voids in areas of the small radii of the container bottoms. Coating voids result when the "corners" are not wetted with coating material. Thus, there is a need to improve an electrocoating electrode probe to flow electrocoating material into the small radii of the container bottoms and to improve the "throwing power" of the electrode probe to uniformly electrocoat container interiors.

It is known in the art of coating to insert nozzles into container bodies for coating the same wherein the nozzles have a plurality of openings such that coating material is directed in a specific pattern. U.S. Pat. No. 3,643,727, issued Feb. 22, 1972, discloses a process and apparatus for electrostatic spray coating the interior of a conductive metal tube as the tube is being extruded. A probe includes a nozzle having coaxial spray ducts of annular section angled outwardly with respect to the axis of the probe and additional openings on the periphery of the probe connected with exhaust ducts for exhausting excess coating material from the interior of the metal tube. U.S. Pat. No. 3,410,250, issued Nov. 12, 1968, discloses a spray nozzle for applying a uniform coating with two streams of thermosetting resin within a container interior. A venturi-type opening having a beveled outer annular section provides a low density spray to the closed end of the container and orifices on the periphery of the tubular member of the nozzle direct high density spray substantially radially outwardly from the tubular member. A nozzle for spraying fine powder suspended in a divided flowing gas stream is disclosed in U.S. Pat. No. 3,422,795 issued Jan. 21, 1969. The nozzle orifice has an expanding horn with parabolic surfaces which diverts coating material primarily to the container bottom and corners. The outside surfaces of the expanding horn are to direct coating material outwardly with minimum disturbing effect on the laminar flow. It is also known to use spray nozzles for producing fan-shaped patterns to match internal surface configurations, such as is shown in U.S. Pat. No. 3,737,108, issued June 5, 1973, and U.S. Pat. No. 2,964,248, issued Dec. 13, 1960.

Further, it is known that a flow-through electrode may have a plurality of orifices evenly spaced about its periphery, as shown in U.S. Pat. No. 3,399,126, issued Aug. 27, 1968, which discloses an apparatus for electrodeposition using a plurality of conduit electrodes submerged in a bath of coating material for directing streams of coating material against selected surfaces of a submerged article having a complex configuration.

Such prior art nozzles for both atomizing and airless spray coating are inadequate for several reasons for processes using a flowing bath of electrocoating material. Maintaining a "fill" of flowing electrocoating material in a container is essential, as well as avoiding any discontinuities of flow, such as created by air pockets and excessive turbulence. Such prior art nozzles, which develop specific spray patterns, not only promote discontinuities, but also are inconsistent with a process of a transient flowing bath of electrocoating material where a fill is maintained to completely wet the container surfaces to be coated. Further, nozzles useful in slower prior art processes for electrocoating articles submerged in a bath of coating material are not suitable for high speed production, such as is typical in the can-making industry. There exists a need, therefore, for a probe-electrode of improved "throw power" for controlling the flow of electrocoating material into the deep recesses and corners of containers without creating discontinuities of flow so as to uniformly electrocoat the container.

SUMMARY OF THE INVENTION

In accordance with the present invention, an apparatus and method are provided for flowing electrocoating material through a probe insertable into a container to be coated and filling the container in a transient bath of electrocoating material while providing a means for establishing in the vicinity of the container end wall a flow of coating material opposite the flow of electrocoating material from the container end wall area to increase the flow turbulence and maintain continuous contact with container interior surfaces.

In addition to satisfying the object of the invention of controlling the flow of coating material in the container interior to facilitate deposition of a uniform coating in the small radii end wall portions and deep recesses and corners of the container, there are some unexpected advantages. Unexpectedly, there is a significant increase in the quantity of coating deposited. Also, a reduction in the voltage and amperage necessary to apply a desired coating thickness has resulted and such voltage reduction has been accompanied by an increase in speed of the electrocoating process. In addition, a reduced coating thickness may meet desired enamel ratings.

DETAILED DESCRIPTION OF THE PREFERRED EMBODIMENTS

Figure 1:
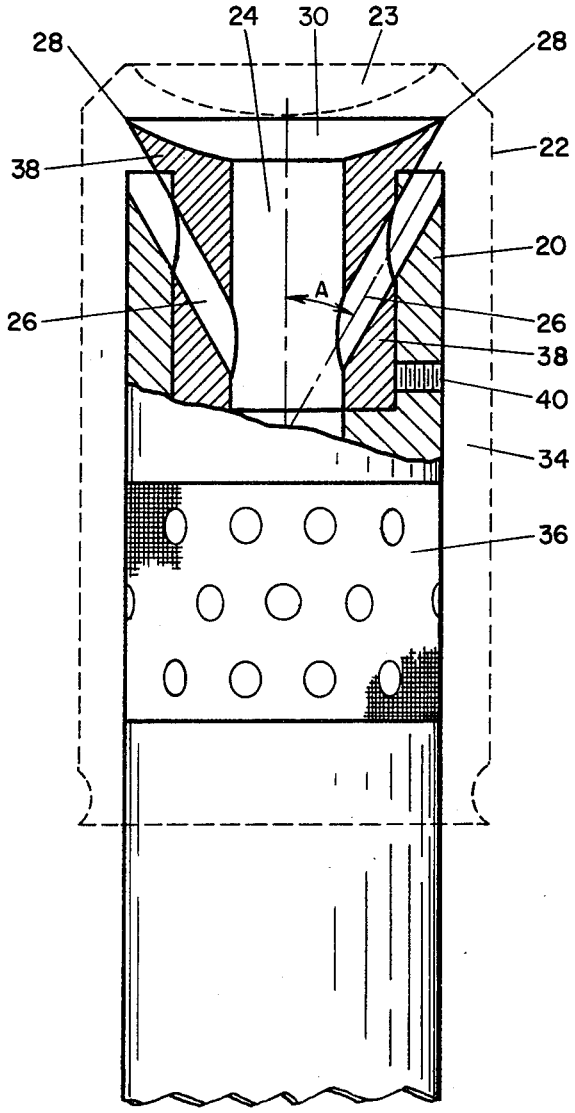
FIG. 1 is a partial cross-sectional view of a preferred embodiment of an apparatus of the present invention.

FIG. 1 illustrates a probe-nozzle 20 arranged within a container 22 (shown in dotted lines) for coating the interior surfaces of the container by flowing electrocoating material through a nozzle bore 24 and passages for openings 26.

Probe-nozzle 20 is shown projecting upwardly into container 22. Probe 20 is hollow and may itself be a nozzle, or may include nozzle portions for flowing electrocoating material into the interior of a container to be coated. Preferably, probe 20 is a nozzle, as shown in FIG. 1, having a nozzle bore 24 extending longitudinally therethrough. Preferably, nozzle bore 24 is connected at its lower portion to a source or reservoir supply (not shown) of electrocoating material in a conventional manner, such as disclosed in U.S. Pat. Nos. 3,922,213 and 4,094,760.

Nozzle bore 24 may be wider at its uppermost portions forming a narrow edge 28 and may have a generally conical or concave opening 30 at its upper portion on the end face of probe 20 to aid the flow of electrocoating material into the interior of container 22. The purpose of a wider opening 30 being conical, concave or having generally diverging walls is for better directional control of the flowing electrocoating material. Such a wider opening closely adjacent a container bottom end wall 23 provides for improved electrocoating of the interior of the can at the container bottom when an electrical potential is impressed between the nozzle and the container. Narrow edge 28 improves flow patterns of electrocoating material into the container interior as well as increasing the "throwing power" of the bath to coat any recesses of the container interior surface.

Probe-nozzle 20 is an electrode and must be electrically conductive, preferably, generally conforms in shape to the interior of a container and is made of anticorrosive or non-corrosive material. As used herein, the shape of various parts of the apparatus of the present invention "generally conforms" to the container shape when the geometric shape, such as cylindrical or cubical, coincides with the container shape, though the detailed configuration of the container including grooves, ridges and the like may not be present. An almost identical relationship between the container interior and the nozzle configuration permits better flow of electrocoating material to all surfaces of the container interior and permits faster electrocoating. A probe-nozzle of almost identical relation to a container is one that conforms in most detail to the interior surface of a container with approximately equal spacing between each point on the exterior surface nozzle and the corresponding point on the interior surfaces of the container.

Probe-nozzle 20 may include a restrictor (not shown), but such as is disclosed in U.S. Pat. No. 4,094,760, on the lower portion thereof which is of a diameter greater than the diameter of probe-nozzle 20. When probe-nozzle 20 is inserted to its fullest extent needed into container 22, a restrictor would be located at or below the area of the probe 20 adjacent the rim of the open end of inverted container 22. The purpose of a restrictor is to maintain or reduce the area between probe-nozzle 20 and the interior surface of container 22 near the rim in order to restrict the flow of electrocoating material from space 34 in the interior of container 22. Restricting the flow may aid in maintaining a full transient bath in container 22 to permit improved electrocoating.

The uniformity of the electrocoating material deposited on the interior of the container 26 may be improved by preselecting the conductivity of various external surface areas of probe-nozzle 20 by use of insulating means 36, such as disclosed in U.S. Pat. No. 4,094,760. A reduction in conductivity can be provided for by the addition of insulating tape, for example, on the surface of probe-nozzle 20. Such tape may be added in any number of a variety of ways and may be solid, or it may contain perforated holes or openings. By trail and error, the appropriate insulating characteristics can be determined for a particular shaped metal container 22.

FIG. 1 further illustrates passages 26 through which electrocoating material can be flowed into the vicinity of bottom end wall 23 of container 22 for establishing opposing flows for filling the deep recesses of a container bottom. In a preferred embodiment, passages 26 are connected with nozzle bore 24 and divert a portion of the electrocoating material through passages 26 from nozzle bore 24. Passage 26 may be a straight bore into nozzle bore 24 and oriented at an angle "A" of less than 90° with the longitudinal axis of probe-nozzle 20 so that electrocoating material is directed generally upwardly (as shown in FIG. 1) toward bottom end wall 23 of container 22. Preferably, a plurality of passages 26 are arranged symmetrically about probe-nozzle 20 and connected with nozzle bore 24 at about the same horizontal plane. Though not shown, alternatively, separate passages, not connected with nozzle bore 24, may be provided for flowing electrocoating material into the vicinity of the bottom end wall of container 22. Preferably, eight passages 26 are equally spaced about the periphery of probe-nozzle 20 with the passage 26 at angle "A" of about 60° from the longitudinal axis of the probe-nozzle.

The diametrical size of passages 26 can be established based on the diameter of nozzle bore 24, the overall pressure and flow rate of electrocoating material and the type of container being coated. Typically, nozzle bore 24 may be on the order of three quarters of an inch (1.9 cm) in diameter and passage 26 may range from 1/16 to ¼ inch (0.159 to 0.635 cm) in diameter. Thus, based on the cross-sectional areas of the nozzle bore and the number and diameter of passageways 26, a percentage of cross-sectional nozzle bore flow area can be calculated. For example, eight ⅛ inch (0.318 cm) diameter passages 26 result in about 22% of the cross-sectional area of nozzle bore 24 at ¾ inch (1.9 cm) in diameter. Eight 3/16 inch (0.476 cm) passages 26 result in about 50% of the nozzle bore flow area. Similarly, eight ¼ inch (0.635 cm) holes are about 88% of the flow cross-sectional area of nozzle bore 24. Thus, eight ⅛ inch (0.318 cm) diameter passages 26 will theoretically "retard" 22% of the flow through nozzle bore 24 by diverting a portion of that flow and by establishing an opposing flow in the vicinity of the container end wall.

Probe-nozzle 20 can also be provided with a means for varying the flow of electrocoating material through passages 26. Head 38 is shown in FIG. 1 as a removable portion of probe-nozzle 20 having therethrough a continuation of nozzle bore 24 terminating in a concave opening 30 and having passages 26 therein connecting with nozzle bore 24. Head 38 can be removed from the upper portion of probe-nozzle 20 by a fastening means, such as set screw 40. Head 38 may be fabricated or made of the same or a similar electrically conductive material as is the remainder of the body portion of probe-nozzle 20. The interchangeability of head 38 permits control to be exercised over the amount of electrocoating material to be flowed through passages 26 into the container interior based on the size and configuration of the container and the flow rate and pressure of electrocoating material. Thus, the appropriate head 38 with the desired configuration and size of passages 26 with the desired amount of flow retarding ability can be chosen depending on the container to be electrocoated. In the alternative, head 38 may have a plurality of different size passages 26 such that rotation of head 38 within probe-nozzle 20 will align passages 26 in such a manner so as to provide the desired retarding effect.

Figure 2:
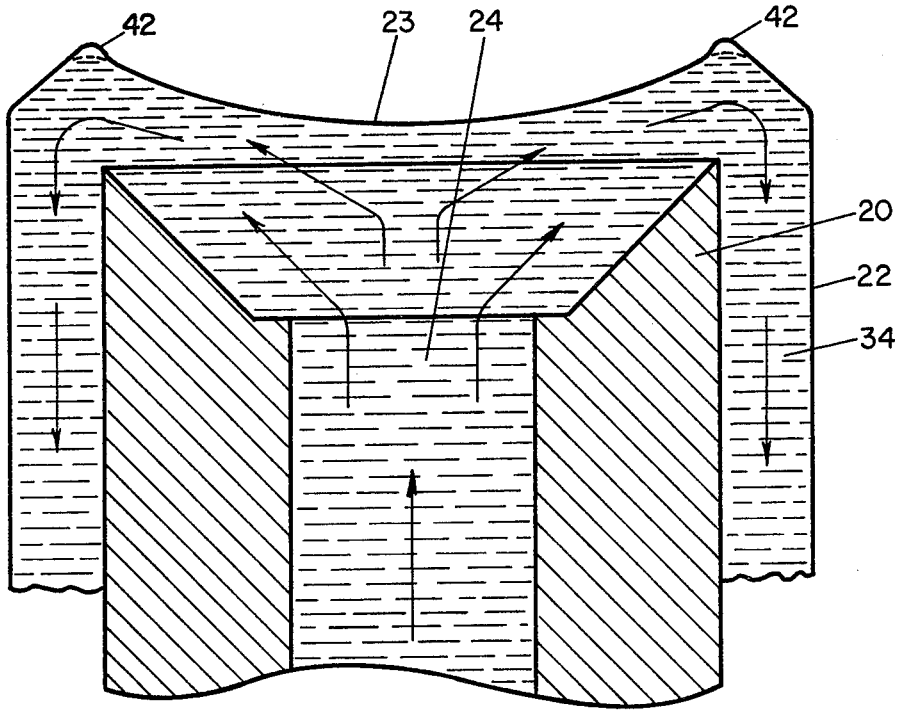
FIG. 2 is a schematic showing the flow of coating material into a container from a prior art probe.

FIG. 2 illustrates a schematic of prior art probe-nozzle 20' within container 22 which has a complex bottom end wall profile. It is further shown that even with the use of a generally conforming nozzle 20' configuration, the container interior has deep recesses 42 of end wall 23 which are not wetted by electrocoating material. Such non-wetted areas can occur even when the flow rate and pressure of the inflowing electrocoating material are controlled. Those parameters are important to control, as discussed in U.S. Pat. No. 4,094,760, to prevent discontinuities caused by turbulence, bubbles, etc., on the interior of the container and to facilitate electrocoating material to continuously contact each point on the interior surface of the container for a uniform coating deposit. Normally, a pressure that is too high results in an increasing velocity of the electrocoating material and in the formation of bubbles, turbulence or the like which is undesirable. In balancing all of the variables, it is still possible and frequent with containers having complex end profiles to have areas which are void of coating material when the electrocoating cycle is completed. It is believed that such voids shown at 42 having a small radii are caused by a laminar flow now penetrating or filling the area even though the container is in an apparent "filled" condition of transient electrocoating material.

Figure 3:
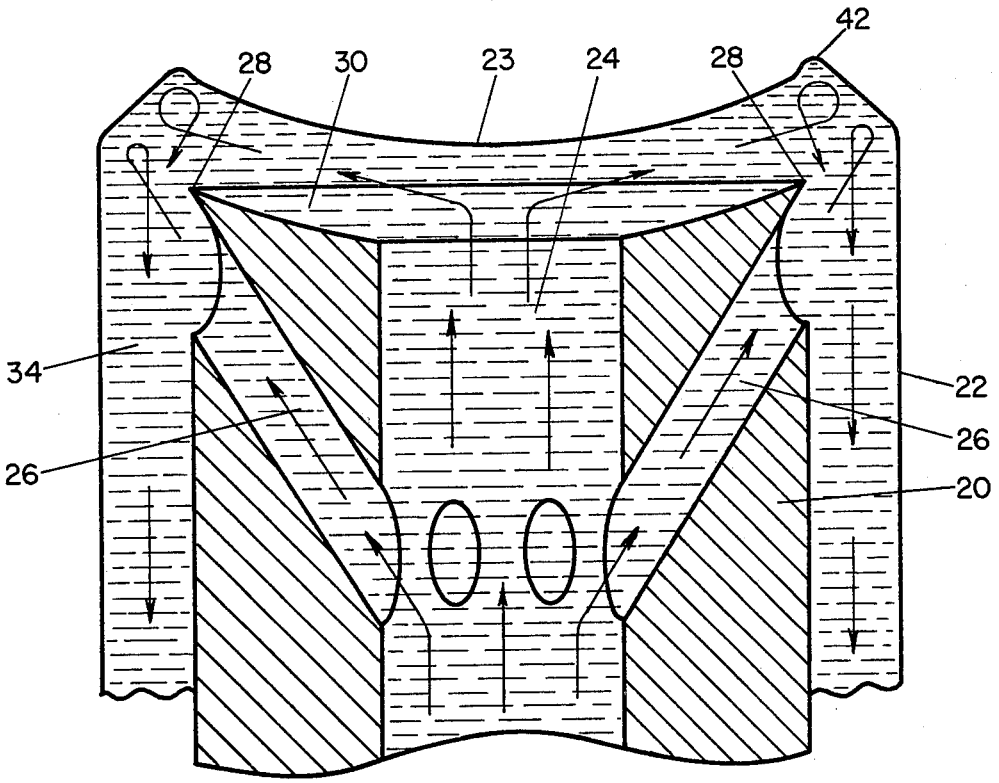
FIG. 3 is a schematic showing the flow of electrocoating material from an apparatus of the present invention.

FIG. 3 illustrates a schematic showing the flow of electrocoating material from the probe-nozzle 20 of the present invention into container 22. The main or primary flow of electrocoating material is through nozzle bore 24 and out the concave opening 30 to space 34 of the interior of container 22 in the region of bottom end wall 23. Electrocoating material is also diverted to a secondary flow through passages 26 into the vicinity of the "corners" of bottom end wall 23 having small radii such as at 42. It is believed that the secondary flow from passages 26 opposes and counteracts the primary flow of electrocoating material as it tends to flow about narrow edge 28 in space 34 between edge 28 and recess 43 and from the "corners" of container end wall 23. The secondary flow forces electrocoating material into small regions and recesses 42 to assure complete contact and wetting of all interior surfaces of container 22. Flow from passages 26 thus retards the flow of coating material which is believed to be otherwise substantially turbulent-free. Such retarding flow tends to increase the turbulence of the electrocoating material flowing in the vicinity of the container end wall 23; however, the turbulence is controlled such that there are no bubbles or discontinuities in flow which would in themselves create void or uncoated areas on the container.

Probe-nozzle 20 of the present invention is particularly suited for use in conventional electrocoating systems such as those disclosed and described in U.S. Pat. Nos. 3,922,213 and 4,094,760. In the latter cited patent, it was disclosed that a flow rate of approximately 500 to 600 milliliters per second of electrocoating material may be used at a pressure of from 4 to 6 psi. Those rates and pressures are applicable with the present invention also. However, in using probe-nozzle 20, it may be necessary to increase the overall pressure slightly to maintain a desired fluid flow rate through nozzle bore 24 when a portion of the flow is diverted through passages 26. Such an increase in overall pressure will overcome in part a decrease in flow and pressure of electrocoating material flowing through nozzle bore 24 into the upper region of container 22 and will maintain the desired fluid flow rate and pressure in bore 24. Thus, when the nozzle is used in its preferred form with passages 26 being connected to nozzle bore 24, electrocoating material diverted from bore 24 to flow through passages 26 can be compensated for by an increase in overall pressure.

Figure 4:
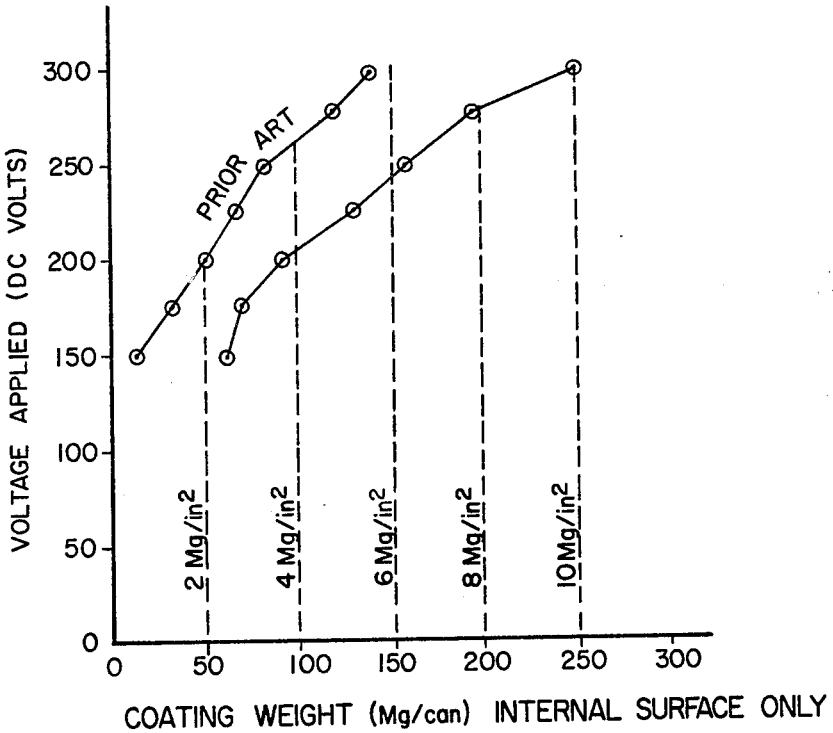
FIG. 4 is a graphic comparison of the coating weights deposited by a prior art probe and a probe of the present invention.

The apparatus and method of the present invention have improved the efficiency of electrocoating processes such as those described in U.S. Pat. Nos. 3,922,213 and 4,094,760 with an unexpected increase in the quantity of coating deposited. FIG. 4 illustrates in graphic form such improved efficiency in a plot of coating weight versus the direct current (DC) voltage applied for both probe-nozzle 20 and for the conventional probe-nozzle 20' of FIG. 2. There it is shown that more coating is deposited with the present invention than the prior art probe over the same voltage range. Probe-nozzle 20, for that example, has eight ¼ inch (0.635 cm) diameter passages 26 and a nozzle bore of ¾ inch (1.9 cm) diameter. To demonstrate the feasibility of the present invention, food cans without deep recesses or "corners" about 2½ inches (6.35 cm) in diameter and 2½ inches (6.35 cm) deep were coated at a rate of about 30 cans/minute and about ½ second voltage time with a resinous coating having a temperature of 110° F. (43° C.).

Figure 5:
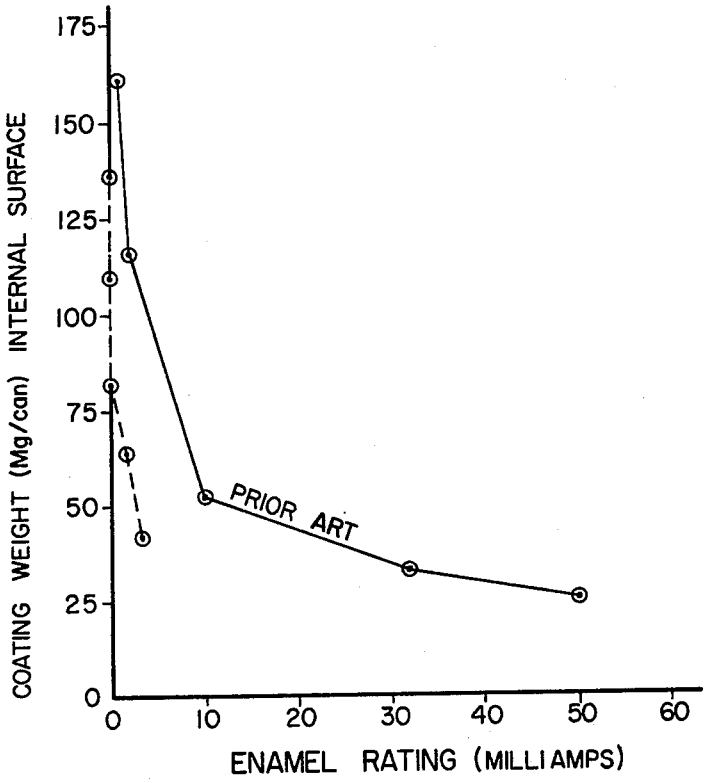
FIG. 5 is a graphic comparison of enamel ratings of coatings deposited by a prior art probe and a probe of the present invention.

The method and apparatus of the present invention also improves the deposited coating distribution to provide improved uniformity of coverage of the container surfaces. FIG. 5 graphically indicates the improved uniformity by illustrating a plot of coating weight on the internal container surface versus enamel rating (ER) for probe-nozzle 20' of FIG. 2 and for the present invention. There it is shown that for the same coating weight deposited, the enamel ratings are lower for the present invention. Probe-nozzle 20 in that example is the same as discussed with regard to FIG. 4. Beverage and beer type cans with a complex end wall configuration, as shown in FIGS. 1 and 3, about 2¾ inches (6.99 cm) in diameter and 4¾ inches (12.07 cm) deep having an internal surface area of about 45 square inches were coated within a voltage range of about 50–150 DC volts and at a voltage dwell time of about 2 seconds. Improved uniformity of coverage over the container internal surface is demonstrated by the fact that improved enamel ratings are achieved when containers of the same area are coated with the same coating weight.

Though a range of 120 to 300 DC volts is preferred for the present invention, it has also been found that voltages as low as 35 volts can provide uniform coatings of reduced thickness and coating weight with desired enamel ratings. For example, the method and apparatus of U.S. Pat. No. 4,094,760 were used on the same type beverage cans for FIG. 5 example to deposit 0.64 mg/in$^2$ coating having an enamel rating of 3 ma. Probe-nozzle 20 with eight ⅛ inch (0.318 cm) passages was used at a voltage of 35 DC volts for 2 seconds. Such experience indicates that the present invention also has the advantage of providing less coating to meet desired low enamel ratings and less voltage and amperage to apply the coating uniformly on the internal surfaces of a container having a complex end wall profile.

In addition, a further advantage indicated is that the speed of the electrocoating process to apply a desired coating thickness may be increased. Such speed tends to be due to the increase in the quantity of deposited coating for given voltages and the ability to apply uniform coatings at reduced voltages.

The probe-nozzle of the present invention thus satisfies its objective of retarding the flow of electrocoating material from the interior of the can to promote wetting of all surfaces of the container including the small radii and deep recesses of the container bottom end wall. In addition, however, it provides the unexpected results with the use of the opposing fluid flows to increase the coating weight deposited at a given DC voltage. Further, the present invention improves the coating distribution to provide the ability for high speed coating of containers, such as cans having complex bottom profiles.

Although a preferred embodiment and alternative embodiments have been illustrated and described, it will be apparent to those skilled in the art that many changes can be made therein without departing from the scope of the invention.

Having thus described the invention, what is claimed is:

1. A hollow electrically conductive probe insertable into a container and suitable for use in a process of electrocoating the container, wherein an electrical potential is impressed between the container and said probe, said probe comprising:

a configuration of general conformity with the container interior;

means for flowing electrocoating material therethrough and into the container closely adjacent the end wall of the container to fill the container interior in a transient bath of electrocoating material; and means for retarding the flow of electrocoating bath from the container interior adjacent the container end wall by establishing an opposing flow of electrocoating material which increases the flow turbulence while maintaining electrocoating material in continuous contact with the container interior surfaces to facilitate electrocoating, said means for retarding the flow of electrocoating material includes a plurality of openings about the periphery of the probe body and through which flowing electrocoating material is directed toward the end of the probe which is placed closely adjacent the container end wall.

2. The probe as set forth in claim 1 which is oriented vertically for flowing electrocoating material upwardly into the container which is inverted with its open end in a downwardly direction.

3. The probe as set forth in claim 2 further including a concave face with an opening therein on the end of the probe which is placed closely adjacent the interior surface of the container end wall and from which electrocoating material flows.

4. In combination with a hollow electrically conductive probe insertable into a metal container, said probe adapted for flowing coating material therethrough and from an end face of the probe, and suitable for use in a process of electrocoating the container, wherein said probe configuration is in general conformity with the container interior and has a substantially concave end face which is inserted innermost and closely adjacent the container end wall, wherein the improvement comprises:

means for establishing a flow of electrocoating material within the container in a direction opposite the flow of coating material from the end face of the probe near the end wall of the container by flowing such material through a plurality of passages about the periphery of the probe body, said passages being directed toward said end face of the probe, and filling the container with a transient flowing bath of such material by retarding the flow of material from the container end wall and by increasing the flow turbulence in the vicinity of the end wall without causing discontinuities in the flow.

5. In a method of electrocoating a container by inserting a hollow electrically conductive probe into an inverted container, flowing a primary supply of coating material through said probe to flood the container in a transient bath of electrocoating material, and impressing an electrical potential between the container and the probe to electrocoat the interior of the container, wherein the improvement comprises:

establishing a secondary flow of coating material in the container in a direction substantially opposite to the primary flow by flowing such material from the periphery of said probe toward the container end wall to retard the flow of primary coating material from within the container and to increase the turbulence of flow while maintaining coating material in continuous contact with the container interior to facilitate electrocoating.

6. A hollow electrically conductive probe insertable into a container and suitable for use in a process of electrocoating the container, wherein an electrical potential is impressed between the container and said probe, said probe comprising:

a configuration of general conformity with the container interior;

means for flowing electrocoating material therethrough and into the container closely adjacent the end wall of the container to fill the container interior in a transient bath of electrocoating material;

means for retarding the flow of electrocoating bath from the container interior adjacent the container end wall by establishing an opposing flow of electrocoating material which increases the flow turbulence while maintaining electrocoating material in continuous contact with the container interior surfaces to facilitate electrocoating; and adjustment means for predetermining the amount of opposing flow to establish the desired amount of flow retarding, said means including an adjustable head portion for controlling the size of a plurality of openings about the probe periphery through which electrocoating material is directed toward the end of the probe.

* * * * *

UNITED STATES PATENT AND TRADEMARK OFFICE

CERTIFICATE OF CORRECTION

PATENT NO. : 4,210,507

DATED : July 1, 1980

INVENTOR(S) : John J. Davidson et al

It is certified that error appears in the above-identified patent and that said Letters Patent are hereby corrected as shown below:

| | |
|---|---|
| Col. 3, line 12 | After "with" insert --the-- |
| Col. 3, line 47 | Change "for" to --or-- |
| Col. 4, line 50 | Change "trail" to --trial-- |
| Col. 6, line 8 | Change "now" to --not-- |

Signed and Sealed this

*Sixteenth* Day of *September 1980*

[SEAL]

*Attest:*

SIDNEY A. DIAMOND

*Attesting Officer*

*Commissioner of Patents and Trademarks*